US007320327B2

(12) United States Patent
Frazier

(10) Patent No.: US 7,320,327 B2
(45) Date of Patent: Jan. 22, 2008

(54) HAIR EXTENSION ATTACHMENT

(76) Inventor: Carol Frazier, 2114 Seward Ave., Evanston, IL (US) 60202-1948

( * ) Notice: Subject to any disclaimer, the term of this patent is extended or adjusted under 35 U.S.C. 154(b) by 132 days.

(21) Appl. No.: 11/197,487

(22) Filed: Aug. 5, 2005

(65) Prior Publication Data

US 2005/0268929 A1 Dec. 8, 2005

Related U.S. Application Data

(63) Continuation-in-part of application No. 11/016,714, filed on Dec. 21, 2004, now abandoned, which is a continuation of application No. 10/336,008, filed on Jan. 3, 2003, now Pat. No. 6,832,614.

(51) Int. Cl.
*A41G 3/00* (2006.01)
*A45G 5/00* (2006.01)

(52) U.S. Cl. ..... 132/201

(58) Field of Classification Search ..... 132/53, 132/201, 54, 55, 56
See application file for complete search history.

(56) References Cited

U.S. PATENT DOCUMENTS 1,424,845 A * 8/1922 Nolan ..... 132/53
2,621,663 A 12/1952 Jenkins
2,865,380 A 12/1958 Mitchell
3,280,826 A 10/1966 Jenkins
3,295,534 A 1/1967 Dorkin
3,385,305 A * 5/1968 Buzzelli ..... 132/105
3,812,867 A 5/1974 Wanderman et al.
4,372,330 A 2/1983 Nelson
4,830,029 A 5/1989 Bird
4,966,173 A 10/1990 Russell
5,072,745 A 12/1991 Cheh
5,107,867 A 4/1992 Barrington
5,121,761 A 6/1992 Meister (Continued)

FOREIGN PATENT DOCUMENTS

DE 3722108 1/1989

(Continued)

OTHER PUBLICATIONS

Printout From www.glamourhair.com Website, Dec. 11, 2002, Describing Various Types of Hair Extension Attachement Means and Other Information.

(Continued)

*Primary Examiner*—Robyn Doan
(74) *Attorney, Agent, or Firm*—Richard C. Litman

(57) ABSTRACT

Various embodiments of wefted hair extension attachments include attachment strands extending from the weft base or edge of the attachment. These attachment strands are braided or intertwined directly into the braids formed in the native hair of the wearer as those braids are being formed, without need for additional sewing and thread, adhesives, or other attachment apparatus. The weft base may comprise a relatively narrow, linear weft edge having the hair strands and attachment strands extending in the same direction therefrom, or may comprise a two-dimensional crown sheet having the hair strands extending from a series of wefts from one surface of the sheet and the attachment strands extending from the opposite surface. Each embodiment may include a separator sheet between the hair strands and the attachment strands, to facilitate the manipulation of the attachment strands during installation.

10 Claims, 11 Drawing Sheets

U.S. PATENT DOCUMENTS

| | | | | |
|---|---|---|---|---|
| 5,357,986 | A | 10/1994 | Hargrett | |
| 5,551,452 | A | 9/1996 | Barlow | |
| 5,575,298 | A | 11/1996 | Hinton | |
| 5,722,434 | A | 3/1998 | Walker | |
| 5,740,819 | A | 4/1998 | Hicks | |
| 6,019,107 | A | 2/2000 | Overmyer et al. | |
| 6,135,122 | A | 10/2000 | Campbell et al. | |
| 6,267,118 | B1 * | 7/2001 | Ito et al. | 132/201 |
| 6,405,736 | B2 | 6/2002 | Townsend | |
| 6,446,636 | B1 | 9/2002 | Vittallo | |
| 2001/0035192 | A1 | 11/2001 | Townsend | |
| 2001/0037813 | A1 | 11/2001 | Ra | |

FOREIGN PATENT DOCUMENTS

| | | |
|---|---|---|
| EP | 876773 | 11/1998 |
| GB | 2327605 | 2/1999 |
| WO | WO 87/05783 | 10/1987 |

OTHER PUBLICATIONS

Printout From www.hisandher.com Website, Dec. 11, 2002, Describing Various Methods of Forming Wefted Hair Extensions.

* cited by examiner

HAIR EXTENSION ATTACHMENT

REFERENCE TO RELATED PATENT APPLICATIONS

This application is a continuation-in-part of U.S. patent application Ser. No. 11/016,714, filed on Dec. 21, 2004 and now abandoned, which is a continuation of U.S. patent application Ser. No. 10/336,008, filed on Jan. 3, 2003, which issued Dec. 21, 2004 as U.S. Pat. No. 6,832,614, which is hereby incorporated by reference in its entirety.

BACKGROUND OF THE INVENTION

1. Field of the Invention

The present invention relates generally to devices and methods for adding supplemental hair to the natural or native hair of a wearer, and more specifically to various embodiments of a wefted hair extension, each extension having a series of attachment strands extending therefrom. The attachment strands of the wefted extensions are braided integrally into the wearer's hair to secure the extension to the natural hair of the wearer.

2. Description of the Related Art

Weaving, which is the process of adding human or artificial hair to the native hair of a person, is a technique that has been known for a very long time. Wigs and toupees of human or artificial hair have been manufactured and used for centuries for various reasons, e.g., to enhance the appearance of the wearer, to cover flaws or imperfections in the natural or native hair of the wearer, to indicate profession, rank, or social status, etc. Most such additions to the natural hair of the wearer result in an artificial appearance, or at least are unsatisfactory in some manner. More recently, the application of relatively smaller hairpieces and extensions has been developed. Such smaller hair extensions are often more satisfactory for the wearer, as they can be more permanently attached to the scalp or native hair of the wearer, and in some cases can be treated and cared for in the same manner as the natural or native hair of the person wearing the hair extension.

A number of different types of hair extensions and application or attachment techniques have been developed over the years, but the basic types of hair extensions may be broadly divided into two categories, i.e., (which consists of loose hair strands which are not attached to one another), and wefted hair extensions in which the hair strands are bound or wefted together along a common line or edge, with the hair extending from this weft or binding. These two different types of hair extensions may be further divided by their method of attachment to the native hair of the wearer. A large number of different attachment or application principles or techniques have been developed over the years, ranging from mechanical attachment (clamps, clips, etc.) to adhesives (chemical or heat setting, etc.) to braiding, weaving, sewing, tying, and/or knotting the hair extension into the hair of the wearer.

Each of the above types of hair extensions and methods of attachment to the head or hair of the wearer, have various disadvantages. In the case of loose, unwefted hair, the attachment process is extremely tedious and time consuming, and is thus relatively costly to perform. The result can be a beautiful and natural appearing hairdo if the hairdresser is talented, with the supplemental hair extension capable of being treated as natural hair and remaining in place for weeks.

The manufacture of bounded or wefted hair was developed to facilitate the application of hair extensions to the head of the wearer, with the bound hair greatly shortening the time required for such an operation or application. However, the various means of attaching such wefts to the hair or scalp of the wearer all leave something to be desired. In the case of adhesives, the chemicals and/or heat applied to bond the adhesive can be injurious to the scalp and/or native hair of the wearer. Mechanical attachments, e.g., small clips and clamps, etc., tend to interfere with hair care, as they can loosen during combing, brushing, or normal hair care procedures and fall from the hair unexpectedly. Where wefted hair extensions are sewn onto the native hair braids of the wearer, the process is time consuming and requires support in removal of the hair extension at a later date, because the natural hair can be easily cut along with the binding threads when the hair extension is removed.

A discussion of the related art of which the present inventor is aware, and its differences and distinctions from the present invention, is provided below.

U.S. Pat. No. 2,621,663, issued on Dec. 16, 1952 to Christina M. Jenkins, titled "Permanently Attaching Commercial Hair To Live Hair," describes a method of attaching loose, unwefted hair to the native hair of the wearer, using a series of strands or fibers which are interwoven with the native and supplemental hair. One end of each strand is attached to a support stand, with the opposite ends of the strands being woven into the wearer's hair. The Jenkins method is not used with wefted hair, nor is there any disclosure of any provision of single or multiple laminations of hair wefts with attachment strands extending therefrom, as in the case of the present invention. The Jenkins method is extremely time consuming and tedious, as a relatively small number of supplemental hairs must be interwoven with the three strands of native hair, with the operation being repeated innumerable times to complete the operation. Moreover, the Jenkins method requires the wearer to use a professional to remove the supplemental hair, as the attachment strands must be cut, and the wearer cannot safely cut the attachment strands him or herself without the near certainty that at least some of the native hair will also be cut. There is no such risk using the present hair wefts and methods of attachment, as the braided attachment need only be unraveled to release the hair wefts therefrom.

U.S. Pat. No. 2,865,380, issued on Dec. 23, 1958 to Princess Mitchell, titled "Hairpieces And Method Of Hair Preparation," describes a two step process wherein a series of French plaits (French braids) are formed transversely about the sides, back, and upper portion of the wearer's scalp, to lie closely adjacent to the scalp in the manner of cornrow type braids. After the braids or plaits are formed, a corresponding series of wefted hair extensions are sewn thereto. This process can take up to twice as long as the present method (attaching hair wefts to native hair by braiding the weft attachment strands into the braids simultaneously with braid formation), as the Mitchell method requires that the braids or plaits be completed first, and then that the extensions be sewn in place along the braids in a separate, subsequent operation. Moreover, the Mitchell method can be troublesome to reverse by the wearer, due to the difficulty in cutting the attachment threads without cutting the native hair of the wearer. The Mitchell method is essentially that described as "weaving with braid track" in the His Or Her Hair website, noted further below.

U.S. Pat. No. 3,280,826, issued on Oct. 25, 1966 to Christina M. Jenkins, titled "Hair Piece And Method Of Making And Permanently Attaching Same," describes the use of garter-type clips for the attachment of hair wefts to the native hair of the wearer. While such clips are easily installed and removed, their bulk and mass make hair care (particularly combing and brushing) difficult, to say the least. The present system does not present such problems, as the scalp surface braid attachment leaves the rest of the hair free along its entire length.

U.S. Pat. No. 3,295,534, issued on Jan. 3, 1967 to Jess Dorkin, titled "Hair Thickening Method," describes the use of a urethane adhesive for the attachment of individual or multiple strands of hair to the scalp or native hair of the wearer. This type of supplemental hair attachment is also relatively time consuming, due to the strand by strand (or relatively few strands) securing at each step. The removal process is not appreciably quicker, due to the need to carefully remove all of the adhesive, either by chemical or other means. The chemicals can be harsh on the scalp and hair of the wearer, and daily grooming, as well as the installation and removal processes, can damage the native or natural hair of the wearer.

U.S. Pat. No. 4,372,330, issued on Feb. 8, 1983 to Charles W. Nelson, titled "Method And Apparatus For Attachment Of Hair Units," describes the use of filaments of fine wire or the like, which are twisted about a relatively small number of grouped strands of native hair of the wearer, and secured using an adhesive. The strands are sewn in place using a needle, and continue from strand group to strand group to form a continuous chain. The result provides a base for the attachment of supplemental hair thereto, but Nelson does not disclose any actual supplemental hair configuration or structure in his patent. The Nelson system suffers from the same problems as noted above when supplemental hair extensions are sewn to braids or plaits, in that the hair extensions must be removed by a professional in order to minimize damage to the native hair of the wearer, and moreover, the Nelson system consumes an inordinate amount of time for both installation and removal, as the tedious twisting and gluing of the filament to the native hair of the wearer must be accomplished before the hair extensions may be attached thereto, and removed after removal of the extensions.

U.S. Pat. No. 4,830,029, issued on May 16, 1989 to Raymond F. Bird, titled "Method Of And Apparatus For Styling Hair," describes a manufactured hair weft having a pocket formed in the weft or bound edge or "tape." A wire loop is installed in the pocket, and is used to attach the hair extension to the native hair of the wearer. While the Bird method does not require the braiding or plaiting of the wearer's native hair, the specialized wire loop and pocketed weft tape are relatively bulky and massive, and result in some discomfort for the wearer when attempting to rest or sleep. The use of a wire clip or loop to secure the hair extension to the native hair also creates some difficulty in hair care during brushing, combing, etc.

U.S. Pat. No. 4,966,173, issued on Oct. 30, 1990 to Della L. Russell, titled "Hairpiece For Compensation Of Hair Loss," describes a headband having supplemental hair disposed thereon. The Russell headband is easily installed and removed by the wearer, but is intended only to cover a relatively small patch. The Russell band cannot support a relatively large and full hair extension, with its relatively large mass, as can the present system with its positive attachment to the native hair of the wearer.

U.S. Pat. No. 5,072,745, issued on Dec. 17, 1991 to Byung J. Cheh, titled "Hair Extension Process," describes the use of hot melted adhesive to bond small groups of strands of supplemental hair extensions to the native hair of the wearer. Cheh does not disclose the use of any form of wefted hair extension with his process. The Cheh process, and the problems associated therewith, is more closely related to the process described in the Dorkin '534 U.S. Patent, described further above, than they are to the present invention.

U.S. Pat. No. 5,107,867, issued on Apr. 28, 1992 to Mark C. Barrington, titled "Process For Extending Human Hair," describes the installation of a small plug to the ends of a relatively small number of strands of supplemental hair. A heat shrink sleeve is installed near the base of a relatively small number of strands of the wearer's native hair, and the plug of the supplemental hair group is placed in the heat shrink sleeve. The heat shrink sleeve is then shrunk to grip the supplemental hair plug therein. This technique results in the same problems as incurred with methods wherein the supplemental hair is glued or mechanically fastened to small tufts of the wearer's native hair, i.e., the difficulty in combing or brushing out the hair when a large number of relatively small nodules are installed therein. Also, while Barrington states that the supplemental hair plugs may be removed by reheating them, this is a job for a professional. Such a task could not be readily accomplished by the wearer of the Barrington hair supplements, by herself.

U.S. Pat. No. 5,121,761. issued on Jun. 16, 1992 to Karen L. Meister, titled "Method For Attaching Hair Extensions," describes the use of a series of small sleeves which are crimped about relatively small clumps or tufts of native hair, near the bases thereof. A wefted hair extension is then sewn through the bases of the tufts, using a needle and thread. The Meister method eliminates the need to braid the native hair of the wearer, but substitutes a series of small crimped sleeves, which must be removed professionally when the wearer wishes to remove the hair extensions. The Meister system, with the exception of its use of a wefted hair extension, more closely resembles the supplemental hair attachment method disclosed in the Barrington '867 U.S. patent, discussed immediately above, than it does the present supplemental hair attachment method.

U.S. Pat. No. 5,357,986, issued on Oct. 25, 1994 to Drucilla W. Hargrett, titled "Hair Locking Process And Apparatus," describes a braid assembly which is secured to tufts of the native hair of the wearer, rather than braiding the native hair itself. The braid attachment includes a series of small rings therein, with the weft of supplemental hair also having a like series of rings. The weft and braid rings are sewn together to secure the supplemental hair weft to the braid attachment of the wearer. This process involves a fair amount of time, as the braid material must be braided into the hair of the wearer, before the wefted hair extension can be sewn to the rings of the braid. This ring-to-ring attachment is relatively loose in comparison to the present wefted hair extension attachment, and moreover cannot be removed by the wearer, due to the need to determine the location of the attachment thread precisely in order to cut it without damaging the native hair of the wearer.

U.S. Pat. No. 5,551,452. issued on Sep. 3, 1996 to Eslie O. Barlow, titled "Hairpiece With Adjustable Support Loop," describes a loop having a series of hair tufts extending therefrom. The loop has an adjustable circumference, but is still placed relatively loosely upon the head. No means for positively attaching the loop or supplemental hair to the natural hair of the wearer is disclosed.

U.S. Pat. No. 5,575,298, issued on Nov. 19, 1996 to Cassandra Hinton, titled "Apparatus And Method For Concealing Attachments Of Hair Supplements," describes a relatively short and narrow adhesive tape for concealing the braid line of a conventional hair weave attachment braid, e.g., the weave attachment braid as disclosed in the Mitchell '380 U.S. patent discussed further above. The Hinton tape includes a covering of relatively short hairs on the outer surface thereof, to camouflage the underlying braid and weft attachment. The hair weft extension disclosed in the Hinton U.S. patent is conventional, i.e., it does not include any attachment strands, as provided by the hair weft extensions of the present invention.

U.S. Pat. No. 5,740,819, issued on Apr. 21, 1998 to Janice A. Hicks, titled "Process For Securing Supplemental Hair To The Natural Hair Of An Individual," describes a relatively complex process in which a wefted hair extension is bound by sewing a series of blanket stitches therein adjacent to one end thereof, with the bound portion of the weft then being sewn into a previously formed braid in the wearer's native hair. The Hicks method is quite complex in comparison to the present method, and requires considerably more time to complete. Moreover, Hicks requires professional care in the removal of hair extensions attached using her method, due to the need to carefully sever the strands of thread securing the hair extension wefts to the braids without damaging the native hair of the wearer. This is not a problem with the present hair weft extensions and method.

U.S. Pat. No. 6,019,107, issued on Feb. 1, 2000 to Tatiana L. Overmyer et al., titled "Detachable Hairpiece," describes a barrette type device having a hair extension permanently attached thereto and extending therefrom. The barrette clips to the native hair of the wearer, with the hair extension extending from the barrette to provide the appearance of longer hair for the wearer. No wefted hair extensions having attachment strands extending from the wefted ends for attachment directly to the native hair of the wearer, is provided by Overmyer et al. Moreover, the Overmyer et al. barrette extension cannot be worn for extended periods of time, as can the present wefted hair extensions.

U.S. Pat. No. 6,135,122, issued on Oct. 24, 2000 to Annie L. Campbell et al., titled "Self Adhesive Hair Weft Extension And Method Of Attaching Same," describes a wefted hair extension having a contact adhesive strip applied to the wefted or bound end of the hair extension. A release strip is removed from the adhesive, and the hair extension is adhesively attached to the native hair of the wearer for use. The adhesive principle also results in damage to the hair when the tape is removed, with at least some hair being torn, broken, and/or pulled out by the roots. Campbell et al. do not disclose a hair weft extension having attachment strands extending therefrom for intertwining into the native hair of the wearer as that hair is French braided, as is done by means of the present hair extension attachment.

U.S. Pat. No. 6,405,736, issued on Jun. 18, 2002 to Valerie Townsend, titled "Method Of Using A Self Adhesive Hair Extension," describes a hair extension and process which are very closely related to the disclosure of the Campbell et al. '122 U.S. patent discussed immediately above. Townsend differs from Campbell et al. in that Townsend sews a strip of adhesive material to the wefted end of the hair extension, and adhesively attaches her hair extension to the scalp of the wearer, rather than to the hair, as is the case with Campbell et al. Townsend does not disclose any attachment strands extending from the wefted end of the hair extension for intertwining into braids as they are formed.

U.S. Pat. No. 6,446,636, issued on Sep. 10, 2002 to Christine M. Vittallo, titled "Method Of Attaching Supplemental Hair To Human Natural Hair," describes the application of a liquid adhesive directly to the scalp or native hair of the wearer, and then adhesively securing a weft of supplemental hair to the adhesive area. This method is more closely related to the adhesive attachment methods of the Campbell et al. '122 and Townsend '736 U.S. patents, than it is to the present invention with its attachment strands extending from the weft portion of the hair extension for intertwining with a braid formed of the wearer's native hair.

U.S. Patent Publication No. 2001/35,192, published on Nov. 1, 2001, titled "Self Adhesive Hair Extension," describes a wefted hair extension and method of attachment which closely resemble those described in the '736 issued U.S. patent to the same inventor, described further above. No non-adhesive attachment means using strands of material extending from the hair weft, is disclosed by Townsend.

U.S. Patent Publication No. 2001/37,813, published on Nov. 8, 2001, titled "Attachable Hair Extension," describes the use of an adhesive strip disposed across the individual strands of a mass of hair to form a wefted hair extension. Some of the adhesive is exposed between the individual hair strands. A release sheet is removed from the adhesive, and the weft is applied to the hair or scalp of the wearer, with the exposed adhesive between the hair strands serving to secure the weft to the hair or scalp of the wearer. This hair extension and method are more closely related to the various adhesively applied hair extensions of the Campbell et al. '122 and Townsend '736 U.S. patents and the Townsend '192 U.S. patent Publication, than it is to the present hair extension attachment invention with its intertwining of the weft attachment strands with the braiding of the wearer's native hair.

International Patent No. WO 87/5783, published on Oct. 8, 1987, titled "A Method Of And Apparatus For Styling Hair," describes the same invention as that described in the '029 U.S. patent to the same inventor, discussed further above. The points raised in that discussion are seen to apply here, as well.

German Patent No. 3,722,108, published on Jan. 12, 1989, titled "Device For Attaching Artificial Hair To Natural Hair," describes (according to the drawings and English abstract) a small cylindrical sleeve or clamp which is secured to the native hair of the wearer, with a weft of hair having a cooperating mechanical attachment device extending therefrom. The assembly is somewhat related to that disclosed in the Barrington '867 U.S. patent, discussed further above, in which a small heat shrink sleeve is secured about a tuft of the native hair of the wearer, and a plug forming the end of a hair extension. While the '108 German Patent Publication discloses the mechanical attachment of a complete weft of hair, no disclosure is made of provision for a series of attachment strands from the weft, for interweaving with the native hair.

European Patent No. 876,773, published on Nov. 11, 1998, titled "Method, Apparatus And Hair Extension Product Thereof," describes a method of forming hair weft extensions from loose locks of hair, by applying a thermoplastic resin to the ends of the hair strands to seal them together. The '773 patent Publication is primarily directed to a tool for forming the hair wefts in the desired shape and sealing or adhesively attaching the common ends together. No means is disclosed for attaching the completed wefted hair extensions to the native hair of the wearer, as described in the present disclosure.

British Patent No. 2,327,605, published on Feb. 3, 1999, titled "Scalp Patch For Hair Extension," describes a patch having hair extending from one surface for securing to the central area of the scalp of a wearer. The edge of the patch is devoid of hair, and provides a margin for sewing the patch to cornrow braids formed in the native hair of the wearer.

The Arogundada '605 patent Publication further discloses the use of a plurality of parallel cornrow braids formed in the native hair of the wearer, and stitching one or more lengths of wefted hair extensions together in a sinusoidal configuration for greater fullness. However, no disclosure is made by Arogundada of any provision for attachment strands extending from the weft or bound edge of a hair extension, for interweaving or intertwining into braids formed in the native hair of the wearer, as provided by the present invention.

In addition to the above patents and patent publications, the present inventor is aware of certain web sites which also describe wefted hair extensions and their attachment to the head or hair of the wearer. The sites www.hisandher.com and www.glamourhair.com are sites for commercial outlets which sell loose and wefted hair extensions and materials for their installation in and removal from the native hair of the wearer. Each of the above sites describes various types of wefted hair extensions and methods for braiding, adhesively bonding, weaving, or mechanically attaching such wefted hair extensions to the native hair of the wearer. However, neither of the above web sites disclose any wefted hair extensions having attachment strands extending therefrom, nor any means of intertwining such attachment strands with the native hair of the wearer as it is braided.

None of the above inventions and patents, taken either singly or in combination, is seen to describe the instant invention as claimed. Thus, a hair extension attachment solving the aforementioned problems is desired.

SUMMARY OF THE INVENTION

The present invention comprises various embodiments of wefted hair extensions, with each of the extension embodiments including a series of attachment strands extending from the wefted or bound edge thereof. Methods of attaching the present wefted hair extensions, comprising intertwining the attachment strands integrally with the native hair of the wearer as it is braided, are also disclosed. (The term "native hair" is used generally throughout the present disclosure to describe the hair of the wearer which is rooted naturally in and growing from the scalp of the wearer of the present hair extensions. The term "native hair" is used in order to differentiate from natural hair, as the hair extensions themselves are commonly, and preferably, formed of natural human hair, although not from the native hair of the wearer.)

A first embodiment of the present hair extension comprises a wefted hair extension including a series of attachment strands extending from the weft edge, in the same direction as the hair extending therefrom. This hair extension may comprise a single wefted row, or in a second embodiment may be sewn or otherwise combined with similar extensions to provide multiple rows of overlapping wefts, to create a fuller and more dense hair extension. The attachment strands are preferably sewn between the weft rows, where multiple wefts are secured together. A water insoluble separator sheet is placed between the hair and the attachment strands, to facilitate the manipulation of the attachment strands during installation of the hair extension. The separator sheet is sewn into the hair attachment seam at the weft, and is easily pulled loose after the hair weft is installed.

Other embodiments of the present hair extension attachment include one or more linear weft bases stitched or otherwise attached (e.g., adhesive) to a two-dimensional base sheet. The hair weft(s) is/are secured to one side or surface of the thin, flexible base sheet, with the attachment strands being attached to the opposite side or surface of the base sheet. A separator sheet may be provided about the periphery of the base sheet, if so desired.

Various methods of securing and removing the wefted hair extensions of the present invention to and from the native hair of the wearer are also disclosed herein. These methods all include the common steps of providing a wefted hair extension having attachment strands extending therefrom, and intertwining or braiding the attachment strands integrally into a braid as the braid is formed in the native hair of the wearer. The above-described method or process is considerably quicker and more efficient than other braided attachment processes known to the present inventor, as the braiding of the native hair of the wearer and the attachment of the wefted extensions by means of their attachment strands is accomplished in a single step. The hair extensions are easily removed by the wearer, merely by unbraiding the braids. No delicate cutting of threads, removal of adhesives or numerous small fasteners, or other operations requiring the assistance of a professional are required for the removal of the hair extensions.

Accordingly, it is a principal object of the invention to provide a wefted hair extension having several embodiments, each of which includes a series of flexible attachment strands extending therefrom for intertwining integrally into a braid of native hair of the wearer of the hair extension.

It is another object of the invention to provide such wefted hair extensions in a finishing-piece configuration, having the attachment strands extending from the weft edge in the same direction as the hair strands and with a separator sheet disposed between the hair strands and the attachment strands.

It is a further object of the invention to provide such hair weft extensions comprising a single wefted row or edge, and also comprising multiple, overlapping weft rows or edges to provide fuller and more dense hair in the extension.

Yet another object of the invention is to provide a hair weft extension having a two-dimensional base, i.e., a longitudinal and lateral span, including hair wefts attached to one side thereof and attachment strands extending from the opposite side thereof.

Still another object of the invention is to provide methods of installing and removing the above-described wefted hair extensions into and from the native hair of the wearer.

It is an object of the invention to provide improved elements and arrangements thereof for the purposes described which is inexpensive, dependable and fully effective in accomplishing its intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises various embodiments of a wefted hair extension and methods of attaching and removing the hair extensions to and from the native hair of a wearer of a hair extension. The hair extensions include attachment strands for braiding directly into the native hair of the wearer at the time the braids are formed. This eliminates the two-step process required for hair weaving, wherein a braid(s) must be formed, and then the hair extension(s) is/are attached to the braid(s) in a subsequent operation. Moreover, removal of the present hair extensions may be accomplished by the wearer by merely unbraiding the braided hair to allow the attachment strands of the hair extensions to separate from the natural hair as it is unbraided. No tedious cutting of attachment threads, removal of adhesives, etc., is required with the hair extensions.

Figure 1:
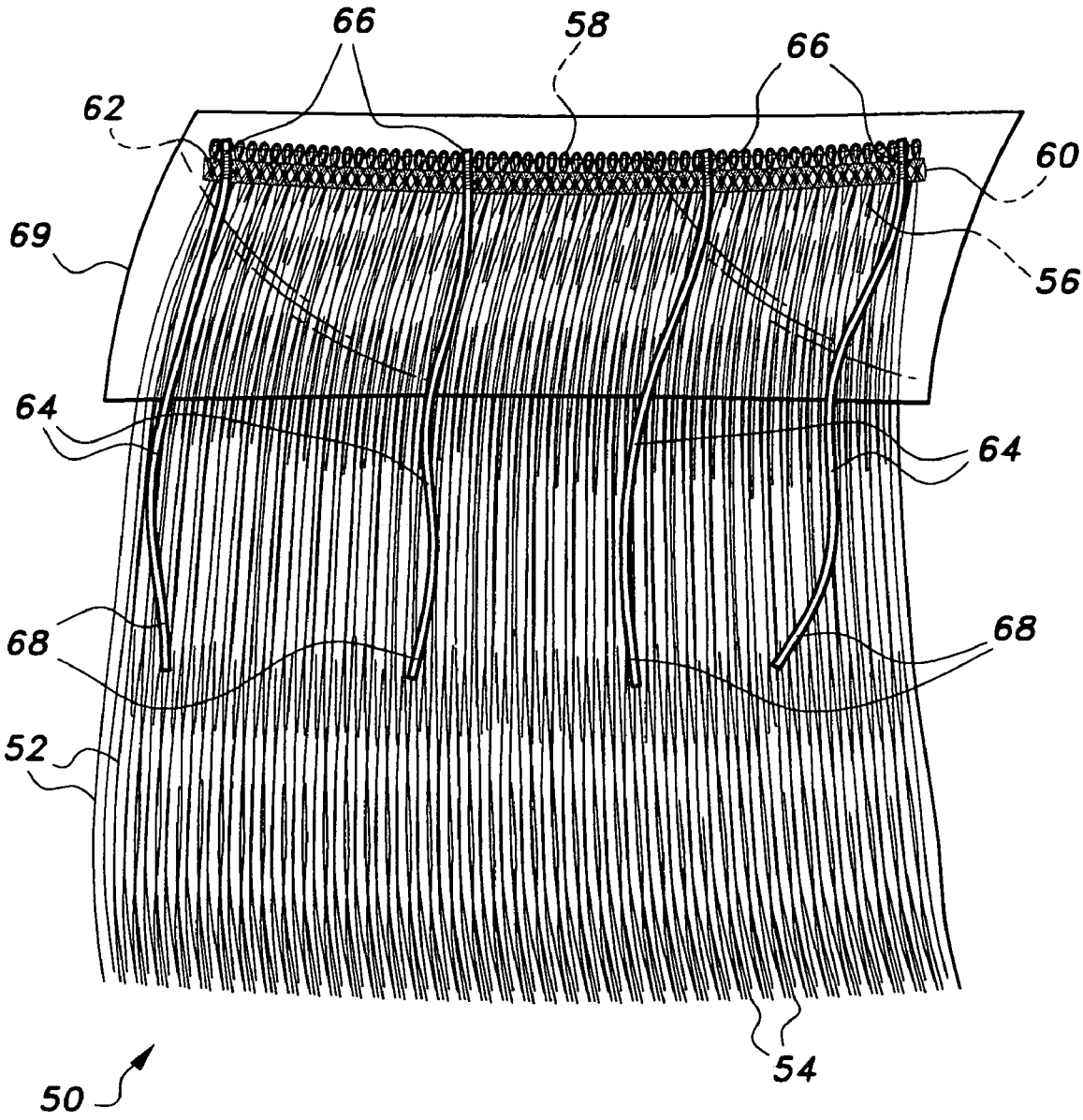
FIG. 1 is a rear elevation view of a first embodiment of a finishing piece hair extension attachment according to the present invention with attachment strands extending from a single weft edge in the same direction as the hair strands for installation along a hairline or part line of the wearer and including a separator sheet between the hair strands and attachment strands.

The hair extensions include a finishing hair extension piece, a first embodiment of which is illustrated in FIG. 1 and designated as wefted hair extension finishing piece 50. The finishing extension piece 50 of FIG. 1 includes a large number of individual hair strands 52 having free ends 54 and opposite weft attachment ends 56. The weft attachment ends 56 are bound together in a single, continuous weft base or edge 58, which spans the extension 50 from a first end 60 to an opposite second end 62. The weft base or edge 58 forms a narrow, thin, essentially one-dimensional linear span due to the relatively fine hair strands 52 and stitching or sewing used to bind the hair strands 52 together along their weft attachment ends 56 to form the weft base or edge 58. Alternatively, the weft attachment ends 56 of the hair strands 52 may be bound together by an adhesive, or an adhesive may be used in addition to stitching the attachment ends 56 of the hair strands 52 together to form the weft base or edge 58. The hair strands 52 extend essentially unidirectionally from the bound weft base or edge 58, and generally form a somewhat planar sheath of hair.

While the extension 50 of FIG. 1 is illustrated as a relatively short and narrow section, it should be noted that the extension 50 and other hair extensions disclosed herein would typically include hair strands having significantly greater length, e.g., eight or more inches, and wefts having substantially greater spans, e.g., thirty-six to eighty-four inches. Both the weft span and hair length of such extensive hair extensions may be cut or trimmed as desired. The relatively small and short extension 50 illustrated in FIG. 1 of the drawings, as well as other extensions disclosed herein, are shown as relatively short and narrow sections for clarity in the drawings. The hair strands 52 used in the construction of the hair extensions are preferably natural human hair. Such hair may be straight, as shown, or may be curled, kinky, or have any other pattern or form as desired. Such natural hair may retain its natural color, or may be dyed or otherwise treated as desired. Alternatively, the hair strands 52 may be formed of synthetic fibers, if so desired.

Rather than being sewn into braids formed in the wearer's hair, as is conventional in hair weaving, the hair extension 50 and other hair extensions of the present invention include a series of flexible attachment strands 64 extending therefrom. The strands 64 have attachment ends 66 sewn or otherwise permanently and securely attached (e.g., adhesive) to the weft base or edge 58 of the extension 50 opposite free ends 68. The attachment strands 64 may be formed of any suitable flexible material, so long as the strand material is compatible with braiding integrally into the native hair of the wearer. Preferably, a fabric-covered elastic material is used, but other elastic or inelastic strands, strings, cords, filaments, natural or synthetic hair, etc., may be used to form the attachment strands of any of the hair extension embodiments of the present invention.

The attachment ends 66 of the attachment strands 64 extend in the same direction from the weft edge 58 as the hair strands 52, with the main lengths and free ends 68 of the attachment strands 64 lying in the same general plane as the hair strands 52 when unseparated therefrom. This provides certain advantages in concealing the weft edge and more particularly the braid, when the hair weft extension embodiment 50 of FIG. 1 is used along a part line or hairline. This process is illustrated in FIGS. 3 through 6, and explained in detail further below.

One problem with the hair strands 52 and attachment strands 64 being essentially coplanar is that they can be somewhat difficult to separate from one another when the finishing piece 50 is attached to the wearer's native hair. This adds to the time and effort required for the stylist or operator to tediously separate the hair strands 52 from the attachment strands 64 in order to braid or entwine the attachment strands 64 with the native hair of the wearer without tying up some of the hair strands 52 of the extension piece therewith. The extra time and attention required to separate the hair strands 52 and attachment strands 64 results in greater cost to the client and a less efficient operation.

Accordingly, a separation sheet 69 is placed between the weft edge 58 and the attachment strands 64 at the time the attachment strands 64 are stitched or otherwise secured to the weft edge 58. The separation sheet 69 extends in the same direction from the weft edge 58 as do the hair strands 52 and attachment strands 64 and serves to separate the hair strands from the attachment strands, thereby greatly simplifying the task of braiding or entwining the attachment strands 64 with the native hair of the wearer while excluding the hair strands 52 of the extension piece 50. The separation sheet 69 may be formed of any suitable material, e.g., a very thin, flexible, transparent sheet of plastic material (e.g., polyethylene, etc.), or even certain water resistant papers or lightweight woven materials, as desired. Preferably, the separation sheet 69 is formed of a waterproof, non-water soluble, or water resistant material, in order to withstand moisture that may be used during the hair extension installation process.

The separation sheet 69 is formed of a relatively weak material, in order to permit it to be torn from its attachment to the weft edge 58 when no longer needed. The separation sheet 69 need not be particularly strong or sturdy to perform its function of separating the hair and attachment strands 52 and 64; a relatively weak material is desired in order to allow it to be torn easily from its attachment along the weft edge 58. The separation sheet 69 may be relatively narrow in the direction of the hair strands 52 and attachment strands 64, as any separation is sufficient to allow the operator or stylist to pull the attachment strands 64 free of the hair strands 52 to perform the attachment procedure. Alternatively, the separation sheet 69 may have a width substantially equal to the lengths of the attachment strands 64, if so desired.

Figure 2:
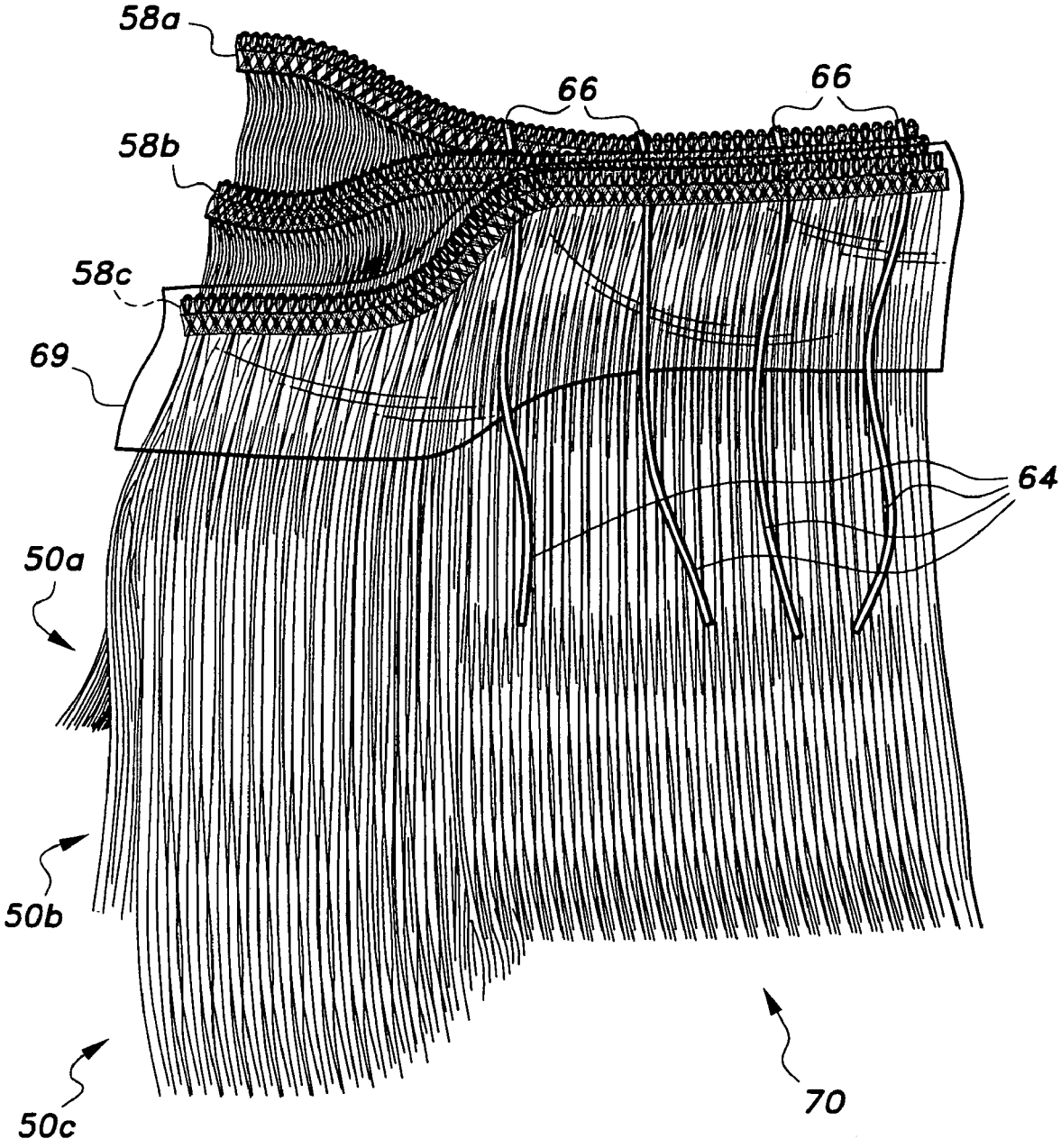
FIG. 2 is a rear elevation view of a partially constructed alternative embodiment of the wefted hair extension of FIG. 1, illustrating the overlapping assembly of a plurality of hair wefts to form a fuller and more dense hair extension.

FIG. 2 illustrates an alternative embodiment of the wefted hair extension 50 of FIG. 1 in which a plurality of such finishing hair extensions are sewn or otherwise permanently secured together along their wefted edges to form a multiple weft extension 70 having a fuller and more dense fall or extension of hair. In FIG. 2, a series of wefted extensions 50*a*, 50*b*, and 50*c*, each substantially identical to the extension 50 of FIG. 1, are assembled together to form the multiple weft extension 70 by sewing or stitching their respective wefts 58*a*, 58*b*, and 58*c* together along their entire lengths. (The multiple weft extension 70 illustrated in FIG. 2 is incomplete, with the final stitching of the wefts 58*a*, 58*b*, and 58*c* shown uncompleted at the second ends thereof, in order to show clearly the three distinct wefts employed in the manufacture of the multiple weft extension 70.) The wefts 58*a*, 58*b*, and 58*c* are secured together in an overlapping configuration, with the upper edge of the weft 58*b* secured slightly below the upper edge of the weft 58*a*, and the upper edge of the weft 58*c* secured slightly below the upper edge of the weft 58*b*.

The weft attachment ends 66 of the attachment strands 64 are preferably captured and secured at the point where the first and second wefts 58*a* and 58*b* are sewn together with attachment strands 64 extending from the wefts 58*a* through 58*c* in the same direction as the hair strands 52*a*, 52*b*, and 52*c*, similarly to the configuration of the single weft finishing extension 50 of FIG. 1. As in the case of the single-ply weft 50 of FIG. 1, the multiple-ply weft assembly 70 of FIG. 2 may include a separation sheet 69 between the attachment strands 64 and the adjacent hair strands 52 to facilitate the separation of the attachment strands 64 during the installation of the extension 70.

Figure 3:
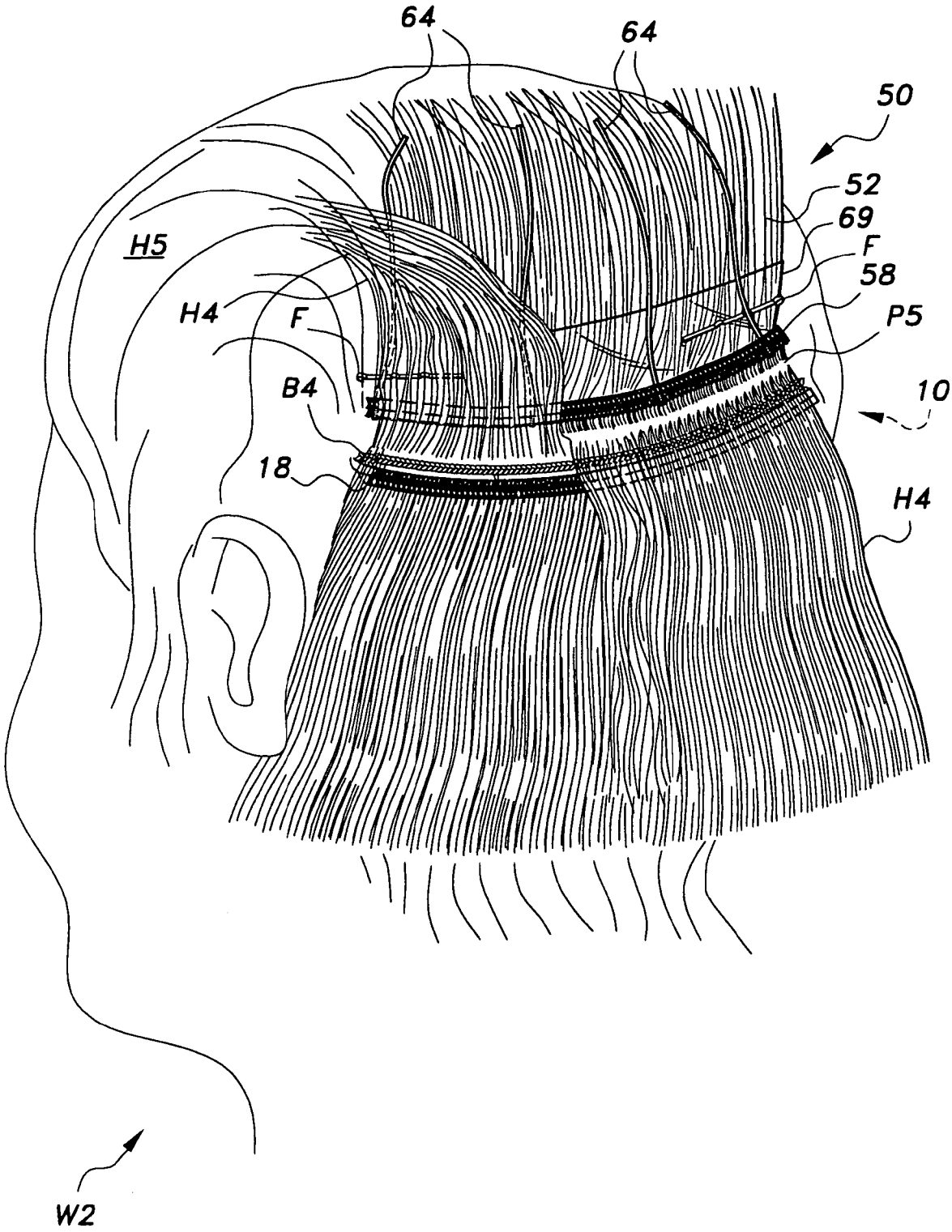
FIG. 3 is a rear perspective view of the head of a wearer of the present hair extension invention, showing a first step in the installation of a hair extension to the native hair of the wearer.

The process by which the wefted hair finishing extensions are installed in the hair of a wearer is illustrated in FIGS. 3 through 6, and described in detail below. Initially, first and second part lines P4 and P5 are formed transversely across the head of a wearer W2 of the finishing hair extension 50, defining a transverse line or row of braidable native hair H4. (The lower part line P4 is concealed by the overlying and downwardly extending braidable hair row H4 in FIG. 3.) The hair 52 of the wefted hair finishing extension 50 is temporarily secured to the underlying, forwardly and upwardly combed hair H5 of the wearer W2 by means of bobby pins or other suitable fasteners F, as shown in FIG. 3. The hair 52 of the finishing piece 50, as well as the attachment strands 64, thus extend upwardly and forwardly over the native hair H5 of the wearer W2 in FIG. 10, with the part line P5 separating the weft edge 58 of the extension 50 from the row of braidable hair H4 extending downwardly below the part line P5. The hair 52 and attachment strands 64 of the extension 50 are separated by the separator sheet 69, at least adjacent to the weft edge 58.

Figure 4:
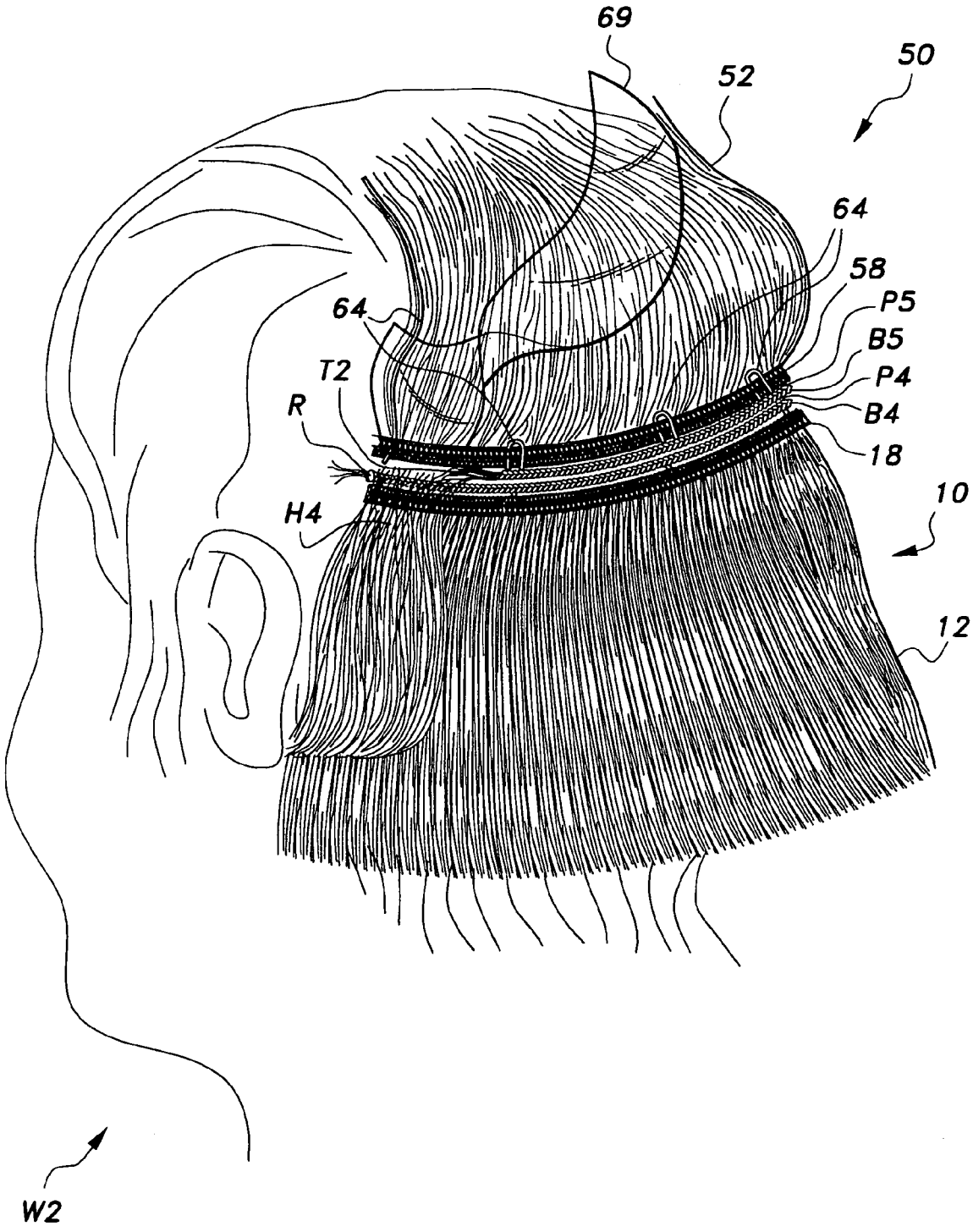
FIG. 4 is a rear perspective view of the wearer's head of FIG. 3, showing the second step in the installation of the hair extension of the present invention.

At this point, a braiding pattern is initiated in the row of hair H4 between the two part lines P4 and P5, generally as shown in FIG. 4 of the drawings. The wefted hair extension attachment strands 64 which have been pulled down and entrained in the braidable hair H4, are braided integrally with the hair H4 during this step in the process. In FIG. 4, the braiding process has been started from the first end of the hair extension 50, to the right side of FIG. 4, working from right to left across the head of the wearer W2 to form the beginning of a finishing piece braid row B5. The initiation of the braiding sequence from the right side is not required, and any braiding pattern may be used as desired, depending upon the orientation of the part lines formed in the hair of the wearer.

The braiding is accomplished by dividing the strands of hair H4 between the two part lines P4 and P5 into three sections to form multiple fingers T2 of the wearer's native hair, and then braiding these fingers T2 together, along with the wefted extension attachment strands 64 as they are encountered with their entrainment in the braiding hair H4 of the wearer. A French or other type of braid may be used as desired, with the braiding lying immediately adjacent the scalp of the wearer. The separator sheet 69 is shown partially removed as the attachment strands are braided into the native hair of the wearer, working from the right side toward the left side in FIG. 4. The intentionally relatively weak structure of the separator sheet 69 allows it to be torn easily from its attachment to the weft base or edge 58 when it is no longer required.

It will be noted in FIG. 4 that since the attachment strands 64 of the finishing piece hair extension 50 extend in a generally upward direction in the same direction as the hair strands 52 extending therefrom, the braiding of these strands 64 into the fingers of native hair formed from the hair row H4 disposed below the weft edge 58 of the finishing piece 50 will draw the strands 64 downward over and across the weft edge 58 as the braid B5 is formed. This is shown by the first three strands 64 extending between the weft edge 58 and the completed portion of the braid B5 to the right side of FIG. 4. The tension on the attachment strands 64 will tend to pull or roll the weft edge 58 over to a certain extent, thereby lifting the attachment ends of the hair strands 52 away from the head of the wearer W2, as illustrated in FIG. 4.

Figure 5:
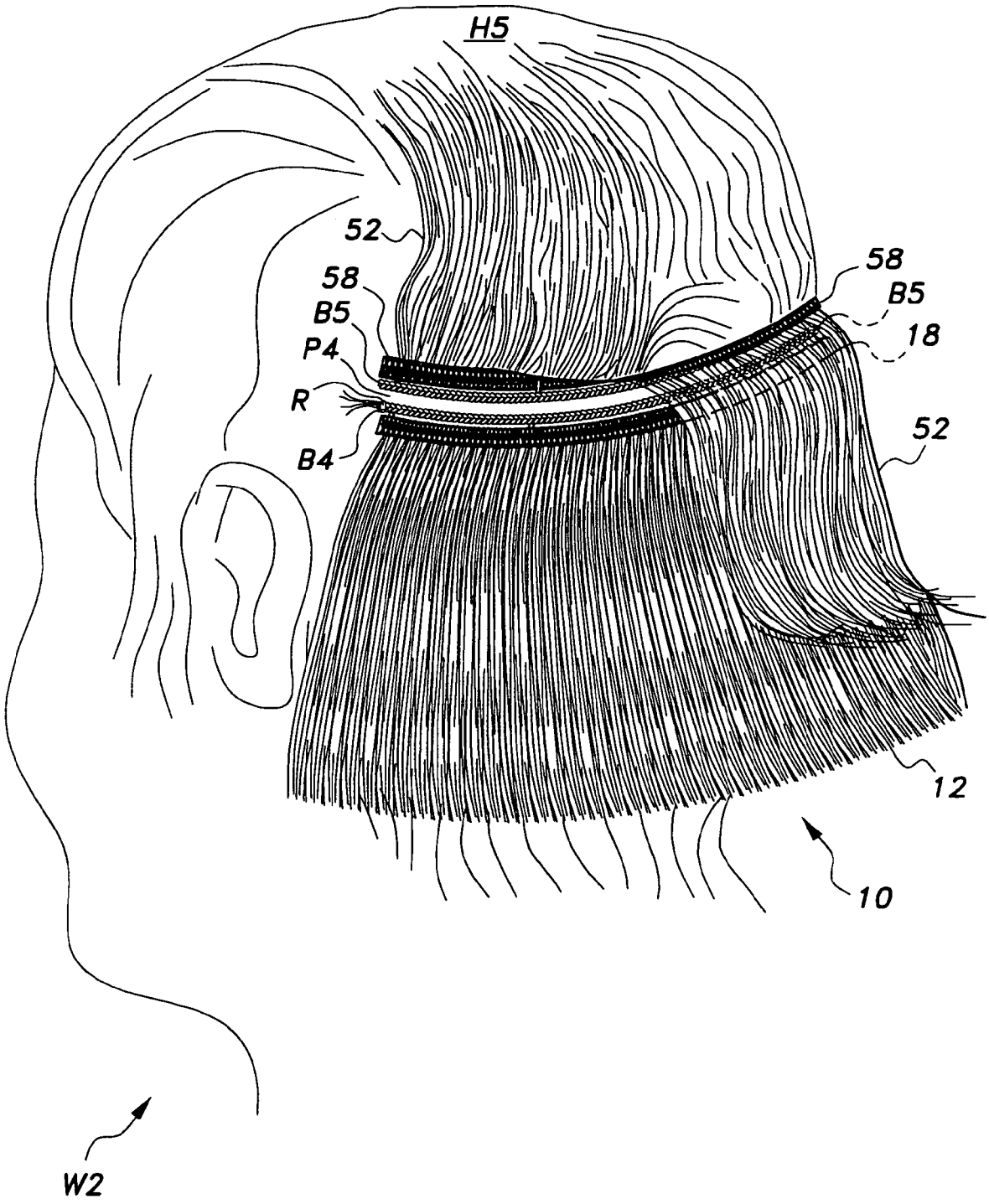
FIG. 5 is a rear perspective view of the wearer's head of FIGS. 3 and 4, showing the third step in the installation of the hair extension of the present invention.

When the braid B5 (and others) has been completed, the otherwise free end is secured by some means, e.g., by wrapping tightly with a small rubber band R or the like, as shown in FIGS. 4 and 5 for the earlier completed braid B4 to which a base extension piece 10 has been secured. At this point, the newly secured weft edge 58 extends along and above the newly completed braid B5. However, it is desired that the hair weft strands 52 extend downward and rearward (in the illustrated example), and merely combing or brushing them over would result in the hair weft strands initially extending upwardly before folding back downwardly over the head of the wearer W2.

A much more natural disposition of the wefted hair strands 52 is achieved by rolling or folding the weft edge 58 of the finishing hair extension 50 over the top of the newly completed braid B5. This also has the advantage of concealing the braid B5 beneath the weft edge 58 of the finishing extension 50, as is the purpose of the finishing extension piece 50. This step is shown in its partially completed phase in FIG. 5 of the drawings, with the right side of the weft edge span 58 having been rolled or folded to lie flat over the top of the underlying braid B5, the corresponding hair weft portion extending naturally downward over the underlying wefted hair 12 of the previously installed base extension piece 10. The opposite, left portion of the weft edge span 58 is shown in essentially the same orientation as shown in the previous FIG. 4, to clearly show the difference in orientation of the two weft edge span 58 end portions and the process of rolling or folding the weft edge 58 over the top of the associated braid B5.

The process for the installation of the finishing pieces 50 (or 70) may be continued to form as many braided rows as desired, with a corresponding number of hair extension weft rows secured thereto by means of the attachment strands braided integrally therewith. The completed braid rows, and hair extension weft rows, may form a relatively wide sinusoidal pattern back and forth over the scalp of the wearer W1, or may alternatively be installed as a series of separate wefted hair extension pieces in separate rows, if so desired.

Figure 6:
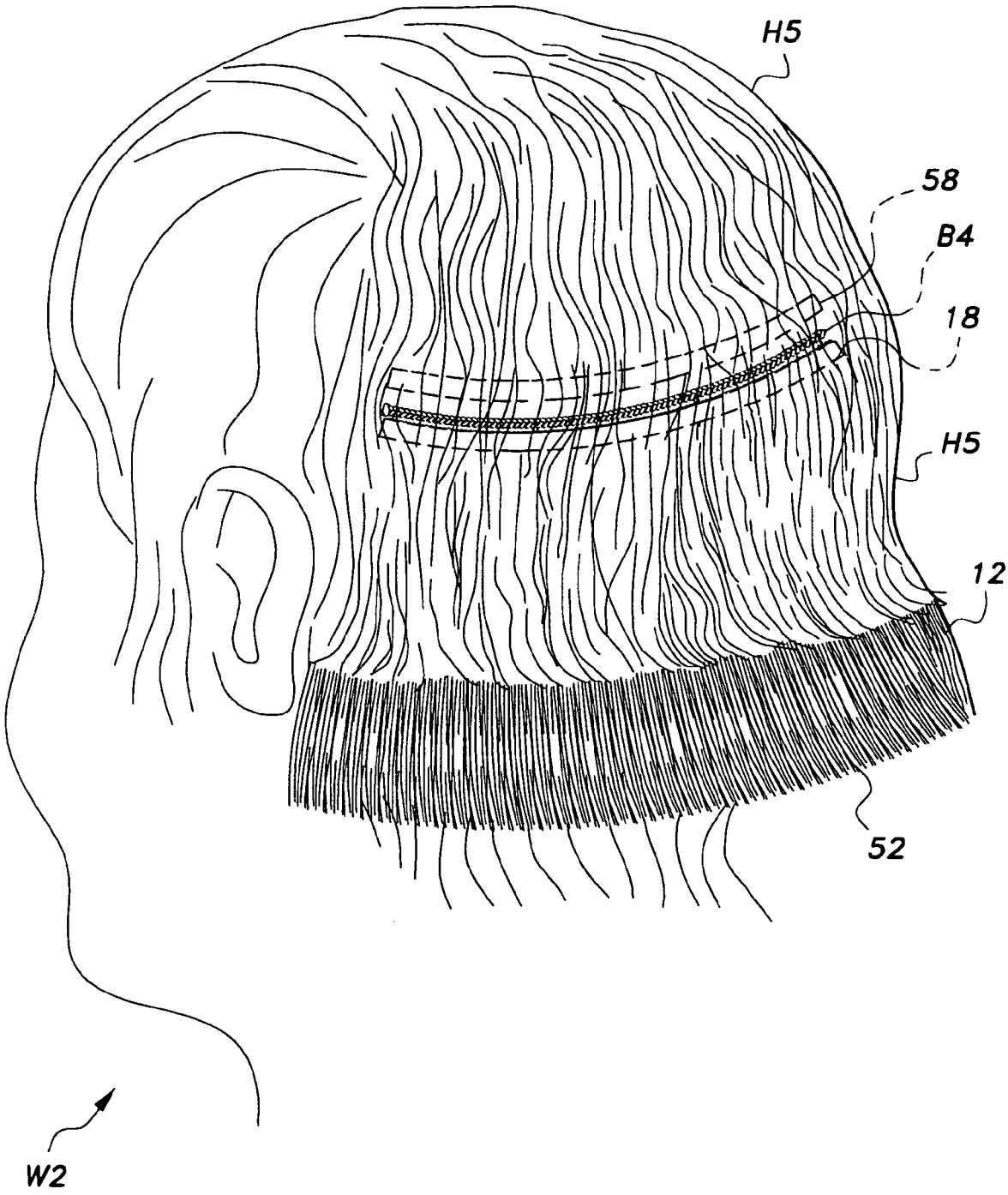
FIG. 6 is a rear perspective view of the wearer's head of FIGS. 3 through 5, showing the fourth step in the installation of the hair extension of the present invention.

FIG. 6 depicts the end result of the above-described hair extensions and integral attachment strands and method of installation. In FIG. 6, the weft edge 58 of the finishing weft extension 50 has been completely folded over to completely conceal the underlying braid B5 (not shown in FIG. 6). The wefted hair 12 of the underlying base piece 10 installed immediately below the finishing piece 50 extends below its respective attachment braid B4. The weft edges 18 and 58 of the two hair extensions 10 and 50, as well as the attachment braid B4 for the base extension 10, are concealed by combing or brushing the native hair H5 of the wearer W2 over the weft edges and braids, generally as shown in FIG. 6.

Figure 7:
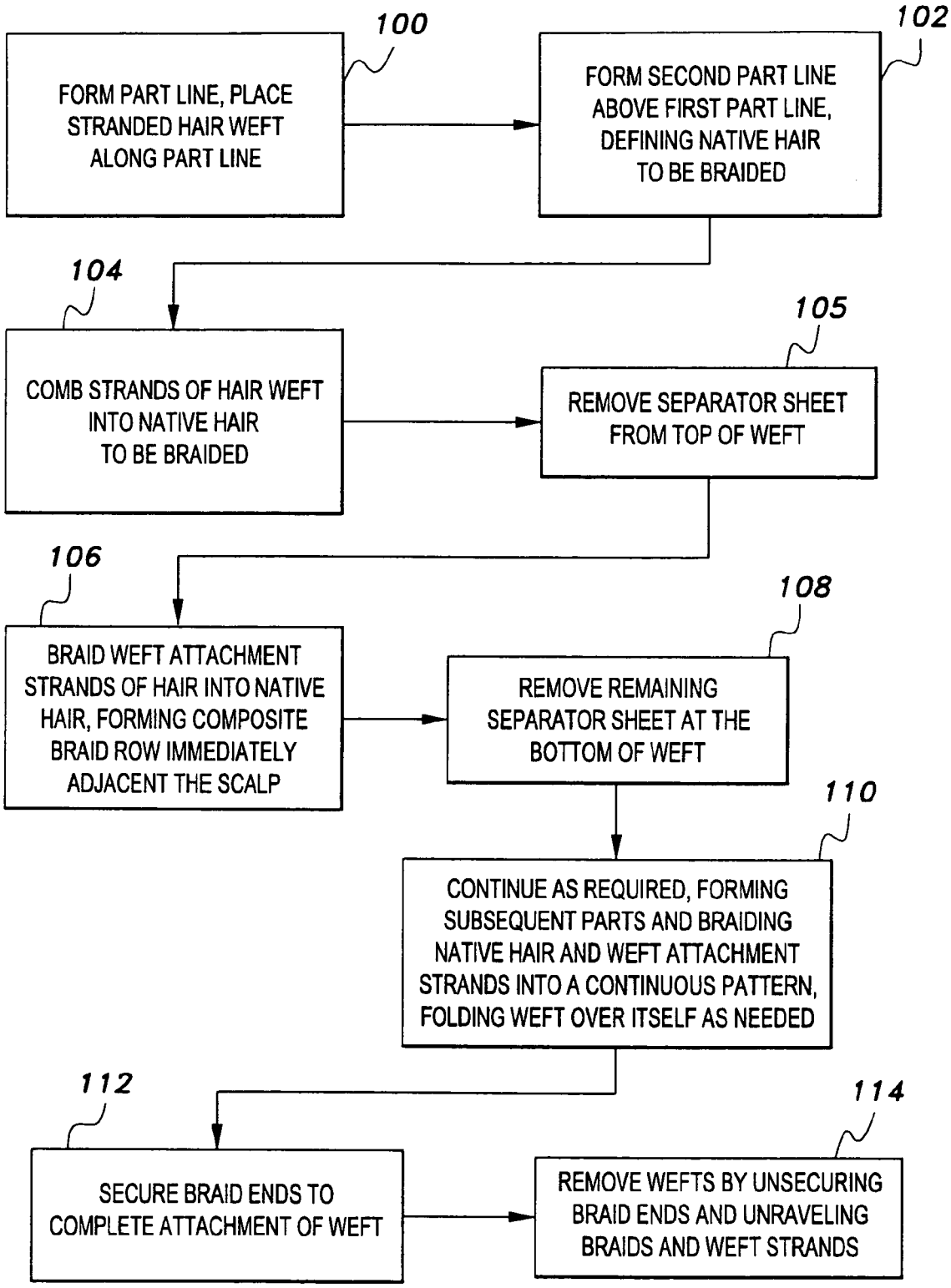
FIG. 7 is a flowchart briefly describing the basic steps in the method of installation and removal of the hair extension attachments of the present invention.

FIG. 7 provides a flowchart briefly summarizing the steps in the method of installation and removal of the wefted hair extensions and their attachment strands. All of the methods of installing the various embodiments of the wefted hair extensions begin by forming a part line along the location of the wearer's head where the hair extension is to be installed, and temporarily securing the hair extension to the native hair adjacent the part line, generally as indicated in the first step 100 of FIG. 7. After this has been accomplished, a second part line is formed slightly removed from the first part line, with the two generally parallel part lines defining a row of the wearer's native hair to be braided, generally as indicated in the second step 102 of FIG. 7.

At this point, the attachment strands extending from the weft edge of the hair extension piece are combed into the native hair to be braided, as indicated by the third step 104 of FIG. 7. This part of the operation is facilitated by the presence of the separator sheet disposed between the wefted hair and the attachment strands, as shown in FIGS. 1 through 4 and described further above. As the attachment strands are progressively combed and braided into the wearer's native hair, the separator sheet may be removed progressively as desired, generally as indicated by the fourth step 105 of FIG. 7. The separator sheet normally has a relatively narrow portion extending to the opposite side of the seam from the hair strands and attachment strands in order to provide positive attachment. This narrow edge of the separator sheet is torn away immediately prior to the placement of the hair extension on the wearer's head to avoid entrapping this edge in the hair as the extension is braided into place. The perforations in the separator sheet due to its stitching to the weft assembly provide a weakening line, which allows the narrow edge of the separator strip to be torn away easily.

The native hair along the row between the part lines is progressively braided from one end to the other, with the hair weft attachment strands braided into the wearer's native hair during the braiding operation to produce a composite braid row comprising the wearer's native hair and the weft attachment strands, generally as indicated by the fifth step 106 of FIG. 7. After each braid is finished the remaining exposed separator sheet is then removed, as indicated by the sixth step 108 of FIG. 7. This process is continued as desired, with subsequent parts being formed in the wearer's hair and braiding the native hair and weft attachment strands continuing until the desired result is achieved, generally as indicated in the seventh step 110 of FIG. 7. Alternatively, a series of separate braids and hair weft extensions may be installed to overlap one another, if so desired.

Once the braiding and weft strand attachment operation has been completed, the free end of the braid is secured to prevent unraveling, generally as indicated by the eighth step 112 of FIG. 7. The result is an attractive hairstyle of full-bodied hair which is very difficult to tell from the wearer's natural hair when the present attachment procedure is performed by a skilled practitioner. The hair extensions and integral attachment strands, and corresponding methods of attachment to the wearer's native hair, allow the extensions to be secured in place to the wearer's native hair simultaneously with the braiding operation, thus saving time otherwise required in a subsequent operation to attach the hair wefts after the native hair has been braided. The attachment of the wefts to the wearer's native hair is as secure as more time consuming sewing methods, and substantially more secure than adhesive or mechanical hair attachment methods. The hair extensions and attachment methods allow the supplemental wefted hair to be worn for up to several weeks at a time, with only normal care (shampooing, brushing, etc.) being required, just as in the case of the wearer's native hair. The wearer of the present hair extensions can swim, change hair styles, wash and otherwise care for their hair, and in general treat their supplemental hair extensions in the same manner as they would their native hair, yet the installation is quite cost effective, due to the labor savings involved.

When the wearer desires to remove or replace the wefted hair extensions of the present invention, it is only necessary to remove the small band or other component securing the distal end of the braid(s), and unravel the braid(s), generally as indicated by the ninth step 114 of FIG. 7. The attachment strands of the hair extensions will automatically separate from the braided strands or fingers of the wearer's native hair, as the braid(s) become(s) unraveled. This operation may be quickly and easily accomplished by the wearer of the hair extensions without need for additional professional care or assistance, as is required where hair extensions are sewn or otherwise mechanically or adhesively fastened to the wearer's native hair. Removal of the hair extensions requires only on the order of thirty minutes or so to accomplish, thus resulting in a relatively minor expenditure even if the wearer decides to have a professional remove the hair extensions.

FIGS. 8 through 11 illustrate additional embodiments of the present hair extension attachment wherein the weft base comprises a two-dimensional sheet of material, rather than a relatively narrow and thin weft edge. The two-dimensional sheet provides broader coverage and is more suitable as a crown piece or the like for covering areas of thinning hair, e.g., bald spots, or for persons (men or women) who may have hair loss due to chemotherapy or other treatments, etc.

Figure 8:
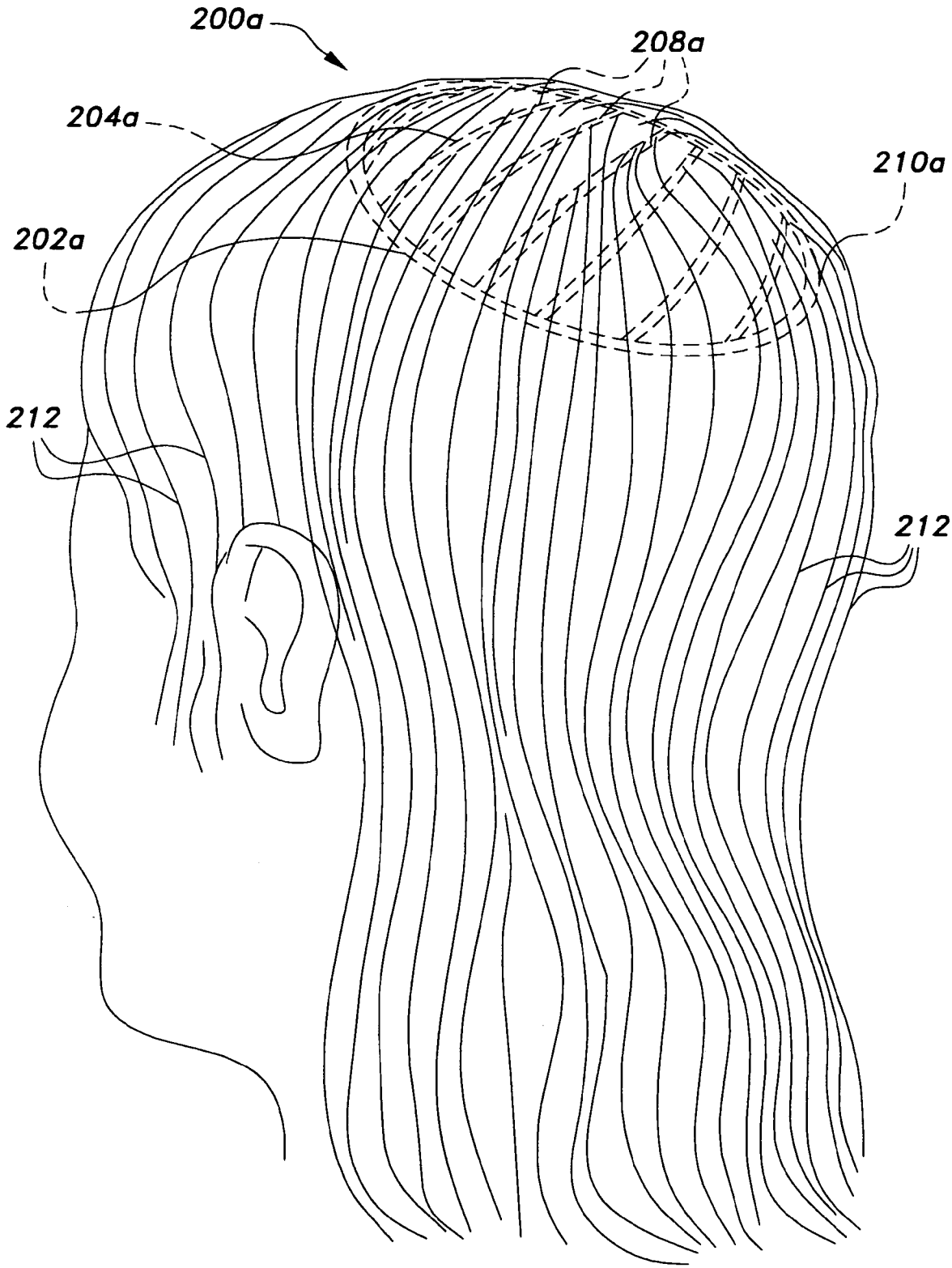
FIG. 8 is a rear perspective view of the head of a wearer of an alternative crown piece embodiment of a hair extension of the present invention having a two-dimensional base.

FIG. 8 provides a top perspective view of the upper or weft attachment surface of a first embodiment 200*a*. The device comprises a thin, flexible, two-dimensional weft base sheet of material 202*a*, having a weft surface 204*a* and an opposite attachment surface 206 (shown in FIG. 10). The weft base sheet 202*a* is preferably formed of a thin, flexible, open weave fabric material. Various lace-type materials have been found suitable in testing, particularly when assembled with a thin mesh sheet to form a composite. Such a structure precludes stretching of the base 202*a*, and provides sufficient strength. The base 202*a* may be provided in any color as desired, e.g., to closely match the flesh tones of the scalp of the wearer. While the device of FIGS. 8 through 10 is round or circular in plan view, it will be understood that this is exemplary, and the base may be formed in virtually any practicable shape or size as desired.

At least one hair weft is secured (e.g., adhesives, stitching, etc.) to the upper or weft attachment surface 204*a* of the base sheet 202*a* to form a two-dimensional array (i.e., spanning the length and width of the base sheet), with the wefted hair extending from the hair weft(s). In the example of FIG. 8, a series of relatively short span hair wefts 208*a* are disposed laterally across the width of the generally circular weft base 202*a*, with a circumferential weft 210*a* extending about the periphery of the weft base 202*a*. Alternatively, the flexibility of such wefts would permit a single weft to be deployed back and forth over the weft surface 204*a* of the weft base sheet 202 in a sinusoidal pattern, or other pattern as desired. The wefts in turn each have a large plurality of hair strands 212 extending therefrom, in the manner of the finishing extension wefts 50 of FIGS. 1 through 6. The orientation of the wefts results in certain specific patterns for the extension hair, and the wefts may be arrayed as desired over the weft attachment surface of the weft base in any of the embodiments as desired. The hair 212 may be formed of strands of artificial or natural hair, as in the case of the embodiment of FIGS. 1 through 6.

Figure 9:
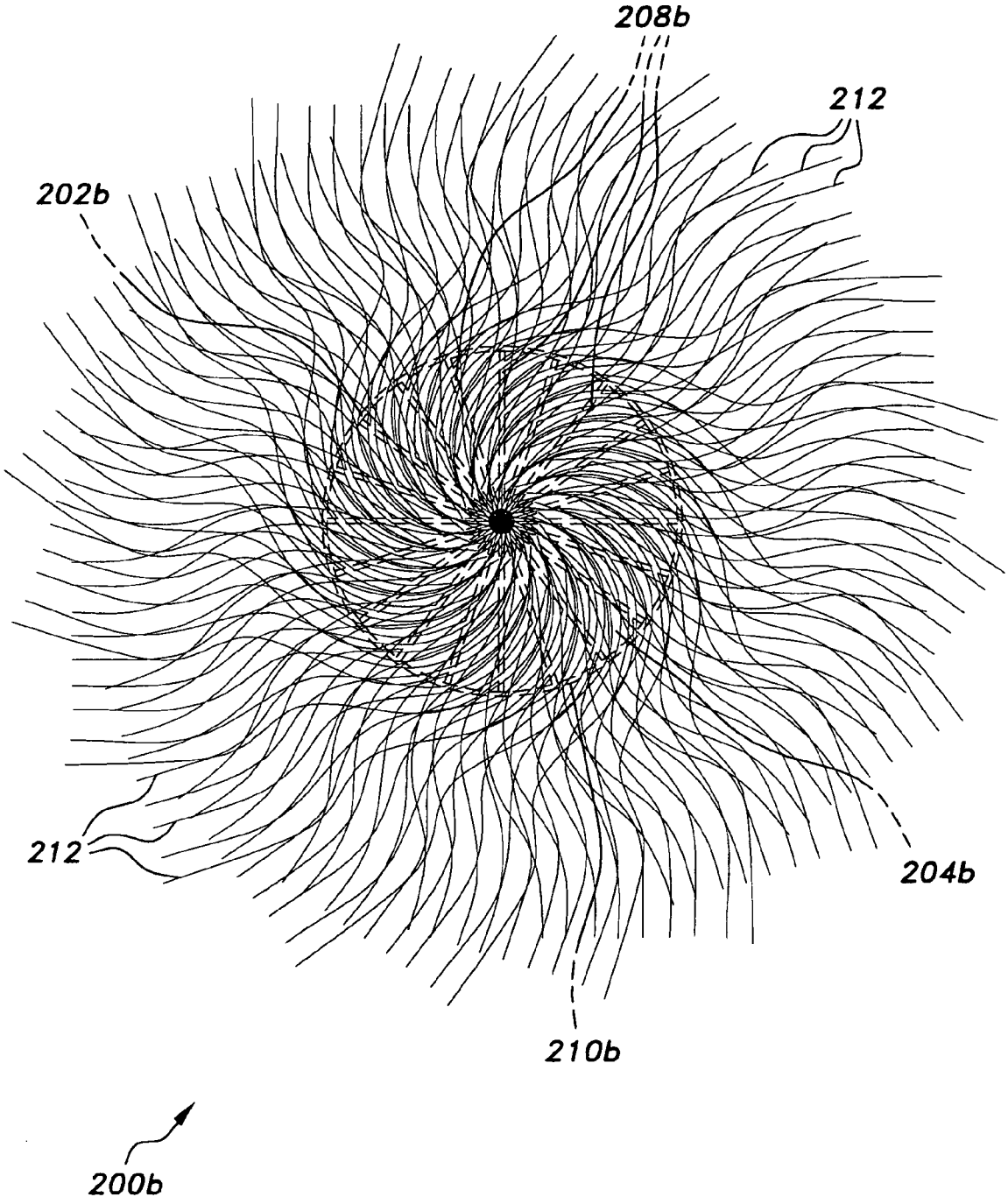
FIG. 9 is a top plan view of the two-dimensional crown piece embodiment of FIG. 8, showing the hair weft attachment pattern thereto.

FIG. 9 is a top plan view of a slightly different embodiment of the crown piece, designated as crown piece 200*b*. The crown piece 200*b* is essentially like the crown piece 200*a* of FIG. 8, comprising a thin, flexible, two-dimensional open weave fabric base sheet 202*b* having a weft or hair attachment surface 204*b* and an opposite attachment surface. A plurality of generally central hair wefts 208*b* are attached to the weft surface 204*b* of the device in a generally radial array, with a circumferential weft 210*b* extending about the periphery of the base sheet 202*b*. Each of the wefts 208*b* and 210*b* includes a large plurality of hair 212 extending therefrom. It will be noted that the radial arrangement of the centralized wefts 208*b* results in the hair extending from those wefts forming a pattern in which the hair from one weft always extends over the attachment of the adjacent weft, thus concealing all of the wefts. The hair from the centralized wefts 208*b* also extends outward sufficiently to conceal the attachment of the peripheral weft 210*b*. The result is a crown piece having a very natural appearance when installed.

Figure 10:
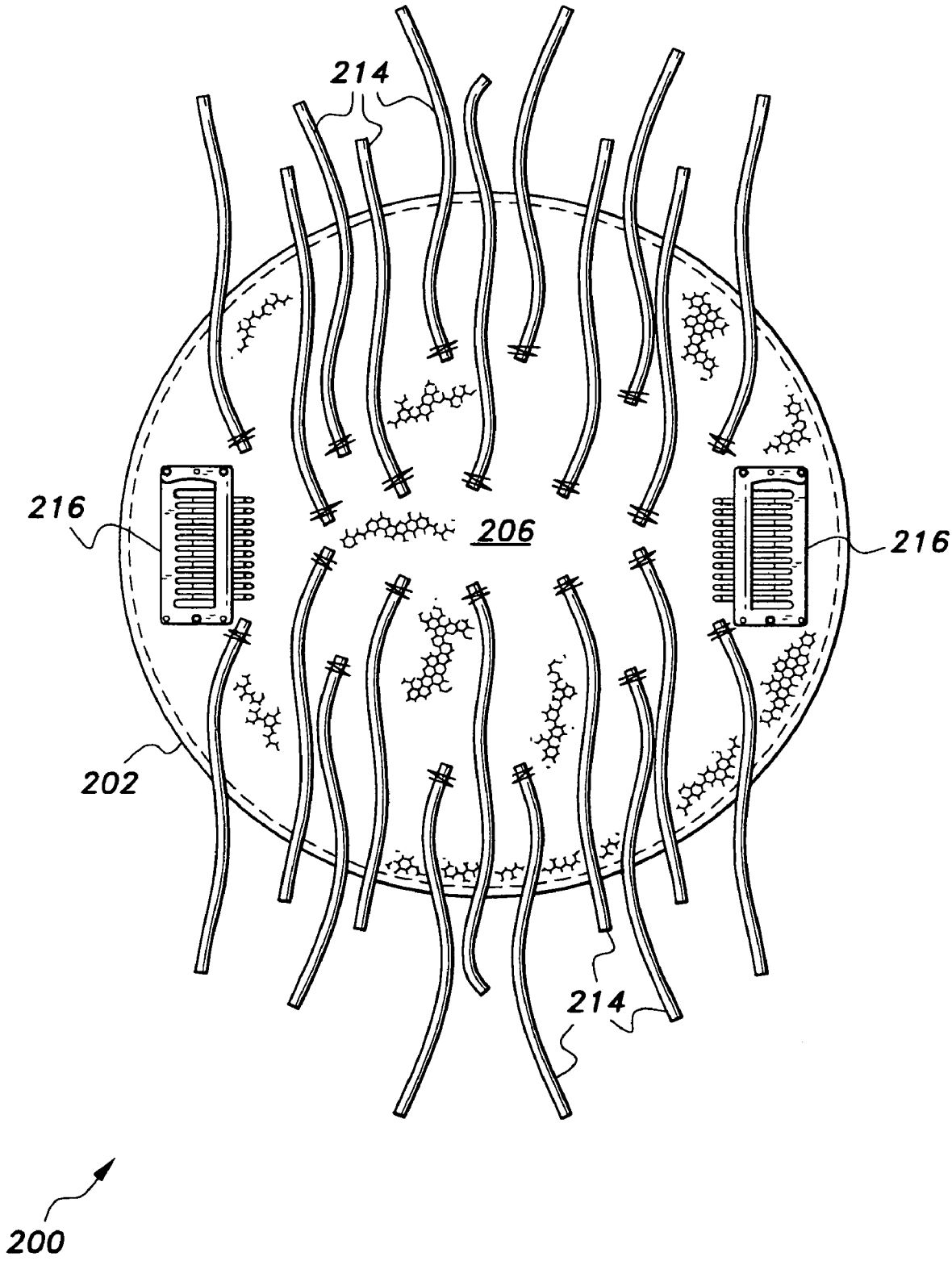
FIG. 10 is a bottom plan view of the two-dimensional crown piece of FIG. 9. showing the attachment strand array extending therefrom.

FIG. 10 provides a bottom plan view of a generic crown piece 200, showing the attachment of the flexible attachment strands 214 to the attachment surface 206 of the device. (The hair strands which would extend outwardly from the opposite unshown side of the crown piece in FIG. 10, are not shown for clarity in the drawing.) As in the case of the attachment strands of the linear weft embodiment of FIGS. 1 through 6, the attachment strands 214 may be sewn or otherwise secured (adhesive, etc.) to the attachment surface 206 of the two-dimensional base sheet 202. The attachment strands 214 are preferably formed of an elastic material, but may alternatively be formed of inelastic materials, if so desired. The strands 214 are used in the same manner as the strands of the linear weft embodiment, interwoven with the wearer's native hair as it is braided in a series of rows to secure the device near the scalp of the wearer.

The attachment side or surface 206 of the device shown in FIG. 10, also reveals a pair of small combs 216 secured thereto. These combs 216 act as supplemental attachment devices, and assist in securing the periphery of the two-dimensional crown piece to the hair to assure that the periphery does not lift to expose its edge or otherwise betray its installation. The combs 216 are not necessarily required, depending upon the number and location of the attachment strands, the nature and condition of the wearer's native hair, and perhaps other factors, but may be included as a supplemental attachment means, as desired.

Figure 11:
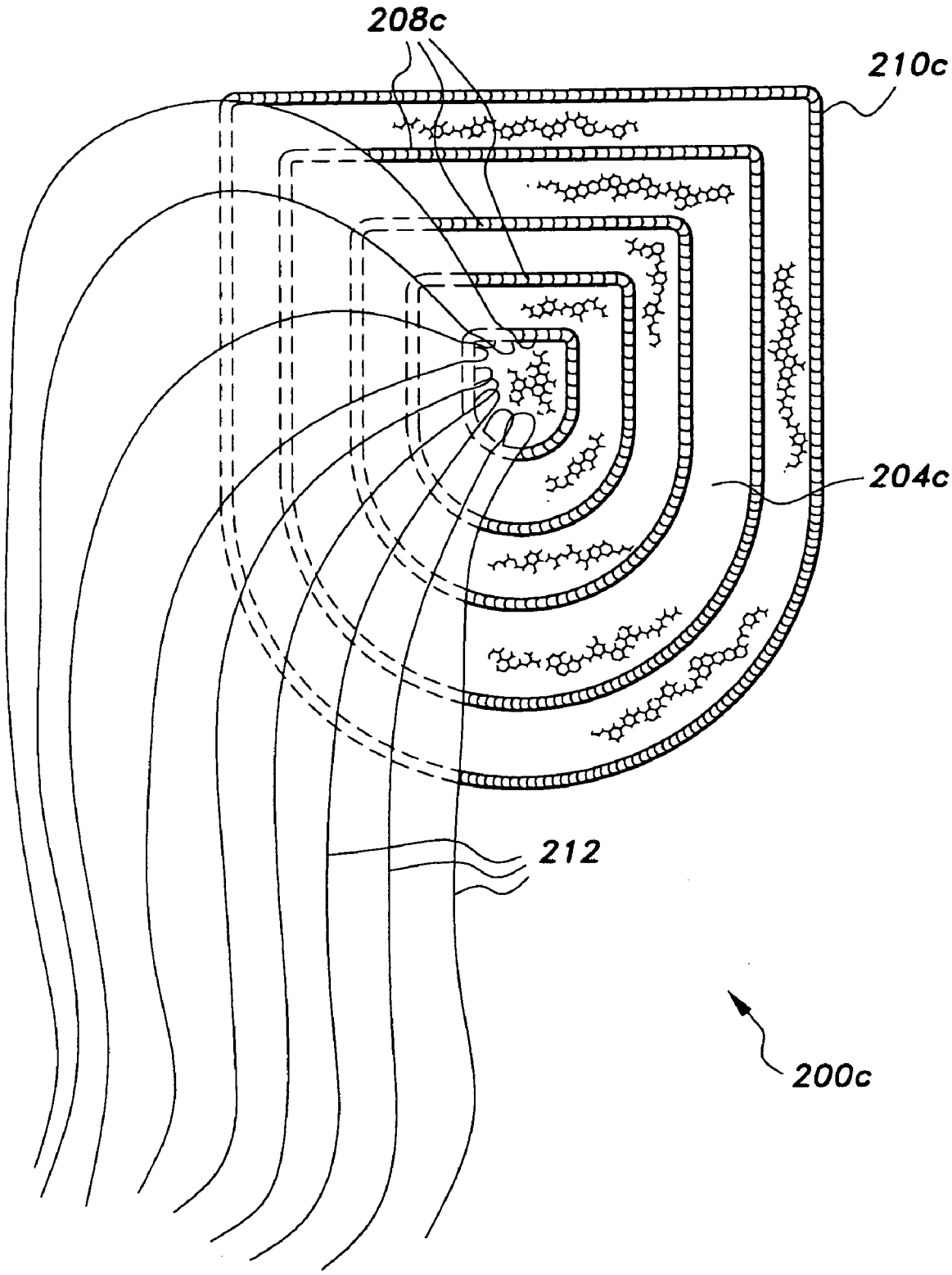
FIG. 11 is a top plan view of an alternative embodiment of the two-dimensional hair extension, with the hair shown partially removed in order to show the weft attachment pattern thereto.

FIG. 11 provides a top plan view of another embodiment of the crown piece attachment, designated as hair extension attachment 200*c*. The crown piece hair extension attachment 200*c* of FIG. 11 differs from those of FIGS. 8 through 10 only in configuration, i.e., its plan view and the layout or pattern of the hair wefts installed thereon. It will be seen that the crown piece attachment 200*c* has a truncated oval shape, with the upper portion (as oriented in the drawing) having a broadly curved shape forming opposed corners with the sides of the device, rather than forming a smooth oval shape, as does the bottom of the device. This shape or pattern is exemplary, and merely shows one of innumerable different shapes or patterns which may be used with the two-dimensional weft attachment embodiment. It will be noted that the wefts 208*c* form a generally concentric pattern, with the outermost weft 210*c* again being installed circumferentially about the periphery of the device. (The hair 212 is only partially shown in FIG. 11, in order to more clearly show the concentric circumferential array of wefts 208*c* and 210*c*.)

Accordingly, the hair extension attachments and attachment methods provide the wearer with considerably more freedom in the care and treatment of their natural hair and supplemental hair, as well as considerably more options for changing styles as desired. The economy provided by the hair extensions and attachment methods, as well as the security and longevity of installation, enable the wearer to visit a hair professional more regularly than might be the case with more time and labor intensive supplemental hair procedures, thus allowing the wearer the option of economizing through the time and labor saved, or enjoying greater freedom to change hairstyles more frequently if so desired. Whatever the desires of the wearer, the hair extension attachments will be greatly appreciated by anyone who has occasion to install supplemental hair extensions in their native hair, whatever the reason may be.

It is to be understood that the present invention is not limited to the embodiments described above, but encompasses any and all embodiments within the scope of the following claims.

I claim:

1. A hair extension attachment, comprising:

a weft base, said weft base including a thin, flexible, two-dimensional sheet having a weft surface and an attachment surface opposite the weft surface;

at least one linear weft is disposed in a two-dimensional array upon the weft surface of said weft base, wherein said at least one linear weft includes a plurality of wefts disposed on said sheet in a radial array and a circumferential weft disposed about a periphery of said sheet;

a plurality of hair strands extending from said at least one linear weft;

a plurality of flexible attachment strands extending from the attachment surface of said sheet; and a separator sheet extending from said weft base between said attachment strands and said hair strands.

2. The hair extension attachment according to claim 1, wherein said weft base comprises an open weave fabric sheet.

3. The hair extension attachment according to claim 1, further including at least one attachment comb disposed upon the attachment surface of said weft base.

4. The hair extension attachment according to claim 1, wherein said plurality of hair strands and said plurality of attachment strands are adhesively secured to said weft base.

5. A hair extension attachment, comprising:

a thin, flexible, two dimensional weft base sheet having a weft surface and an attachment surface opposite the weft surface;

at least one linear weft disposed in a two-dimensional array upon the weft surface of said weft base sheet, wherein said at least one linear weft includes a plurality of wefts in a concentric circumferential array;

a plurality of hair strands extending from said at least one linear weft; and a plurality of flexible attachment strands extending from the attachment surface of said weft base sheet.

6. The hair extension attachment according to claim 5, further including a separator sheet disposed between said plurality of hair strands and said plurality of attachment strands.

7. The hair extension attachment according to claim 5, wherein said weft base comprises an open weave fabric sheet.

8. The hair extension attachment according to claim 5, further including at least one attachment comb disposed upon the attachment surface of said weft base.

9. The hair extension attachment according to claim 5, wherein said plurality of hair strands and said plurality of attachment strands are adhesively secured to said weft base.

10. A hair extension attachment, comprising:

a thin, flexible, two dimensional weft base sheet having a weft surface and an attachment surface opposite the weft surface;

at least one linear weft disposed in a two-dimensional array upon the weft surface of said weft base sheet, wherein said at least one linear weft includes a plurality of wefts disposed on said sheet in a radial array and a circumferential weft disposed about a periphery of said sheet;

a plurality of hair strands extending from said at least one linear weft; and a plurality of flexible attachment strands extending from the attachment surface of said weft base sheet.

* * * * *